US006158424A

United States Patent [19]

Kunimoto

[11] Patent Number: 6,158,424

[45] Date of Patent: Dec. 12, 2000

[54] MODEL GUN WITH AUTOMATIC BULLET SUPPLYING MECHANISM

[75] Inventor: Keiichi Kunimoto, Tokyo, Japan

[73] Assignee: Western Arms, Tokyo, Japan

[21] Appl. No.: 09/207,761

[22] Filed: Dec. 9, 1998

[30] Foreign Application Priority Data

Dec. 10, 1997 [JP] Japan ..... 9-340096

[51] Int. Cl.[7] ..... F41B 11/26

[52] U.S. Cl. ..... 124/73

[58] Field of Search ..... 124/70, 71, 73, 124/74, 75, 76

[56] References Cited

U.S. PATENT DOCUMENTS

| | | | |
|---|---|---|---|
| 2,566,181 | 8/1951 | Fitch . | |
| 2,881,752 | 4/1959 | Blahnik . | |
| 3,788,298 | 1/1974 | Hale | 124/76 |
| 5,063,905 | 11/1991 | Farrell | 124/72 |
| 5,078,118 | 1/1992 | Perrone | 124/73 X |
| 5,257,614 | 11/1993 | Sullivan | 124/73 |
| 5,280,778 | 1/1994 | Kotsiopoulos | 124/73 |
| 5,476,087 | 12/1995 | Kunimoto | 124/73 |
| 5,477,843 | 12/1995 | Kunimoto | 124/73 |

FOREIGN PATENT DOCUMENTS

| | | |
|---|---|---|
| 1-285798 | 11/1989 | Japan . |
| 3-221793 | 9/1991 | Japan . |
| 3-236598 | 10/1991 | Japan . |
| 5-8285 | 5/1993 | Japan . |

*Primary Examiner*—Robert P. Swiatek
*Attorney, Agent, or Firm*—Nixon Peabody LLP; Donald R. Studebaker

[57] ABSTRACT

A model gun with automatic bullet supplying mechanism, which comprises a slider provided to be movable along a barrel and a movable member provided between a bullet holding chamber and a pressure receiving portion to be movable along moving directions of the slider. A first gas guiding passage for guiding gas supplied through a gas leading passage from a pressure accumulating chamber to the bullet holding chamber and a second gas guiding passage for guiding the gas supplied through the gas leading passage from the pressure accumulating chamber to the pressure receiving portion are provided in the movable member to be coupled with each other and, during a period in which the gas leading passage is opened by a movable valve, the movable member is operative to cause gas pressure to act on a sham bullet in the bullet holding chamber so as to move the sham bullet forward from the bullet holding chamber and, after the sham bullet has moved forward from the bullet holding chamber, to cause gas pressure to pass through the first gas guiding passage and simultaneously to act on the pressure receiving portion so as to move the pressure receiving portion back with the slider, in accordance with the difference in resistance against gas flow between the first and second gas guiding passages, and further to move back together with the slider for making preparations for supplying the bullet holding chamber with a sham bullet from a magazine.

5 Claims, 9 Drawing Sheets

MODEL GUN WITH AUTOMATIC BULLET SUPPLYING MECHANISM

BACKGROUND OF THE INVENTION

1. Field of the Invention

The present invention relates generally to a model gun with automatic bullet supplying mechanism, and more particularly to an improvement in a model gun having an automatic bullet supplying mechanism which is operative to supply automatically a bullet holding chamber provided just at the back of a barrel with a sham bullet which is to be shot with gas pressure.

2. Description of the Prior Art

A model gun which is often called an air soft gun is made to imitate a real gun in not only its color and shape but also its apparent operations. As for one of these model guns, which is made to imitate a real gun having a slider provided to be able to move back and forward along a barrel thereof in accordance with triggering action, it has been proposed to make such an arrangement that gas pressure is used for supplying a bullet holding chamber provided just at the back of the barrel with a sham bullet and further for shooting the sham bullet put in the bullet holding chamber, as shown in, for example, Japanese utility model application published before examination under publication number 3-38593. According to the arrangement thus proposed, a pressure accumulating bomb in which compressed air is contained and which has an air leading passage controlled to be open and closed selectively by an operation valve, a magazine for containing sham bullets, first and second valves, first and second air passages and a bullet supplying lever are provided in a grip, an air cylinder is positioned in a slider which is provided to be able to move back and forward along a barrel to be opposite to the rear end of the barrel with a magazine plate between, and a rotary cam engaging with the magazine plate to move the same upward and downward and a spring guide member which moves together with the slider are further provided, so that each of the sham bullets contained in a bullet holding hole formed on the magazine plate is supplied to the inside of the barrel and then shot through the barrel with the compressed air discharged from the pressure accumulating bomb.

In a model gun to which the above mentioned arrangement is applied, when a trigger is pulled, the first valve is caused to operate for permitting the compressed air discharged through the air leading passage opened by the operation valve from the pressure accumulating bomb to be introduced through the first air passage into the inside of the air cylinder and a piston provided in the air cylinder is moved with the pressure of the compressed air to cause the slider to move back. The air cylinder is shifted into the air exhausting condition after the slider has moved back to a predetermined position. The spring guide member also moves back together with the slider to compress a spring member and thereby the rotary cam is rotated to move the magazine plate downward. The bullet holding hole formed on the magazine plate is positioned to be opposite to the sham bullet if the sham bullet is pushed out of the magazine for containing sham bullets when the magazine plate is moved downward. Then, the sham bullet which has been pushed out of the magazine for containing sham bullets is put in the bullet holding hole on the magazine plate by the bullet supplying lever moved together with the trigger.

After that, when the slider moves forward from the backward position to the initial position under a condition wherein the air is exhausted from the air cylinder, the spring member is operative to return the spring guide member to the initial position thereof and therefore the rotary cam is rotated to move the magazine plate upward so that the bullet holding hole formed on the magazine plate in which the sham bullet is put is moved to the initial position to be opposite to the rear end of the barrel. When the magazine plate holding the sham bullet in the bullet holding hole formed thereon has reached the initial position, the second valve is caused to operate for permitting the compressed air discharged through the air leading passage opened by the operation valve from the pressure accumulating bomb to be introduced through the second air passage into the bullet holding hole formed on the magazine plate by a hammer which rotates with the movement of the trigger and the sham bullet put in the bullet holding hole is shot through the barrel with the compressed air introduced into the bullet holding hole.

With the previously proposed model gun in which the air cylinder is provided to form a pressure chamber in the slider which is provided to be movable along the barrel and the sham bullet is supplied to the bullet holding hole formed on the magazine plate by supplying the pressure chamber with the compressed air and discharging the compressed air from the pressure chamber as described above, it is possible to shoot a plurality of sham bullets successively under the automatic bullet supplying operation. However, since an air passage controller which comprises the operation valve, the first and second valves, a connecting portion for keeping the operation valve at the position for opening the air leading passage, a valve control mechanism for controlling the operation of the first valve, the hammer for controlling the operation of the second valve, is constituted as a whole in relatively large scale and so complicated in its construction, it is not easy to make a space in which the air passage controller is to be arranged in the body of the model gun. Besides, the operation valve and the first and second valves which constitute the air passage controller are substantially provided in an air flow space accompanied with the air leading passage extending from the pressure accumulating bomb, and therefore the design of a portion of the model gun forming the air flow space in which the operation valve and the first and second valves constituting the air passage controller are substantially provided, is subjected to relatively severe restrictions.

OBJECTS AND SUMMARY OF THE INVENTION

Accordingly, it is an object of the present invention to provide a model gun with automatic bullet supplying mechanism, in which a bullet holding chamber to which a sham bullet is supplied to be shot with gas pressure is provided just at the back of a barrel and a movable member operative to move back, together with a slider which moves back along a barrel with use of gas pressure from a pressure accumulating chamber, for making preparation for supplying a bullet holding chamber with the next sham bullet after a precedent sham bullet is shot from the bullet holding chamber is also provided, and which avoids the aforementioned disadvantages encountered with the prior art.

Another object of the present invention is to provide a model gun with automatic bullet supplying mechanism, in which a bullet holding chamber to which a sham bullet is supplied to be shot with gas pressure is provided just at the back of a barrel and a movable member operative to move back, together with a slider which moves back along a barrel with use of gas pressure from a pressure accumulating chamber, for making preparation for supplying a bullet holding chamber with the next sham bullet after a precedent sham bullet is shot from the bullet holding chamber is also provided, and in which gas control means comprising an operational valve provided in a gas flow space accompanied with a gas leading passage extending from the pressure accumulating chamber for controlling gas led through the gas leading passage from the pressure accumulating chamber is constituted as a whole in relatively small scale and so simplified in its construction.

A further object of the present invention is to provide a model gun with automatic bullet supplying mechanism, in which a bullet holding chamber to which a sham bullet is supplied to be shot with gas pressure is provided just at the back of a barrel and a movable member operative to move back, together with a slider which moves back along a barrel with use of gas pressure from a pressure accumulating chamber, for making preparation for supplying a bullet holding chamber with the next sham bullet after a precedent sham bullet is shot from the bullet holding chamber is also provided, and in which the restriction in design to a portion of the model gun forming a gas flow space in which gas control means comprising an operational valve is provide, is effectively reduced.

According to the present invention, there is provided a model gun with automatic bullet supplying mechanism, which comprises a pressure accumulating chamber from which a gas leading passage extends, a bullet holding chamber provided just at the back of a barrel, a movable valve for controlling the gas leading passage to be open and closed selectively in accordance with the operation of a trigger pulled in order to cause a sham bullet supplied to the bullet holding chamber to be shot, a slider provided to be movable along the barrel, a pressure receiving portion fixed in the slider to be positioned at the back of the barrel and movable with the slider, and a movable member provided between the bullet holding chamber and the pressure receiving portion to be movable along moving directions of the slider, wherein a first gas guiding passage for guiding gas supplied through the gas leading passage from the pressure accumulating chamber to the bullet holding chamber and a second gas guiding passage for guiding the gas supplied through the gas leading passage from the pressure accumulating chamber to the pressure receiving portion are provided in the movable member to be coupled with each other and, during a period in which the gas leading passage is opened by the movable valve, the movable member is operative to cause gas pressure to act on the sham bullet supplied to the bullet holding chamber so as to move the sham bullet forward from the bullet holding chamber and, after the sham bullet has moved forward from the bullet holding chamber, to cause gas pressure to pass through the first gas guiding passage and simultaneously to act on the pressure receiving portion so as to move the pressure receiving portion back with the slider, in accordance with the difference in resistance against gas flow between the first and second gas guiding passages, and further to move back together with the slider for making preparations for supplying the bullet holding chamber with a sham bullet from a magazine.

The first gas guiding passage may have its bore smaller than a bore of the second gas guiding passage.

In the model gun thus constituted in accordance with the present invention, during the period the gas leading passage is opened by the movable valve, the gas from the pressure accumulating chamber is supplied through the gas leading passage to the first and second gas guiding passages provided in the movable member, then the gas pressure having passed through the first gas guiding passage acts on the sham bullet supplied to the bullet holding chamber and the gas pressure having passed through the second gas guiding passage acts on the pressure receiving portion. As a result, such an operation that first the sham bullet supplied to the bullet holding chamber is moved forward from the bullet holding chamber by the gas pressure acting thereon and then the pressure receiving portion is moved back with the slider by the gas pressure acting thereon under a condition in which the gas continuously passes through the first gas guiding passage, is obtained in accordance with the difference in resistance against gas flow between the first and second gas guiding passages. After that, the moving member moves back together with the slider for making preparations for supplying the bullet holding chamber with the sham bullet from the magazine. Accordingly, gas control means which comprises as main constituting elements the movable valve for controlling the gas leading passage to be open and closed selectively and the movable member provided between the bullet holding chamber and the pressure receiving portion is constituted for controlling the gas led from the pressure accumulating chamber.

Such gas control means is constituted as a whole in relatively small scale and so simplified in its construction. In addition, it is easy to make a space in which the gas control means is to be arranged in the body of the model gun. Further, since only the movable valve is provided in a gas flow space formed to include the gas leading passage extending from the pressure accumulating chamber and the first and second gas guiding passages provided in the movable member, the restriction in design to a portion of the model gun forming the gas flow space, especially a part of the gas flow space including the first and second gas guiding passages provided in the movable member, is effectively reduced.

In the case where the first gas guiding passage has its bore smaller than the bore of the second gas guiding passage, the resistance against the gas flow in the first gas guiding passage is larger than that in the second gas guiding passage. Accordingly, the operation that the pressure receiving portion moves back with the slider after the sham bullet supplied to the bullet holding chamber has moved forward from the bullet holding chamber is obtained with such a very simple construction that only the first and second gas guiding passages are provided in the moving member.

The above, and other objects, features and advantages of the present invention will become apparent from the following detailed description taken in conjunction with the accompanying drawings.

DESCRIPTION OF THE PREFERRED EMBODIMENTS

Figure 1:
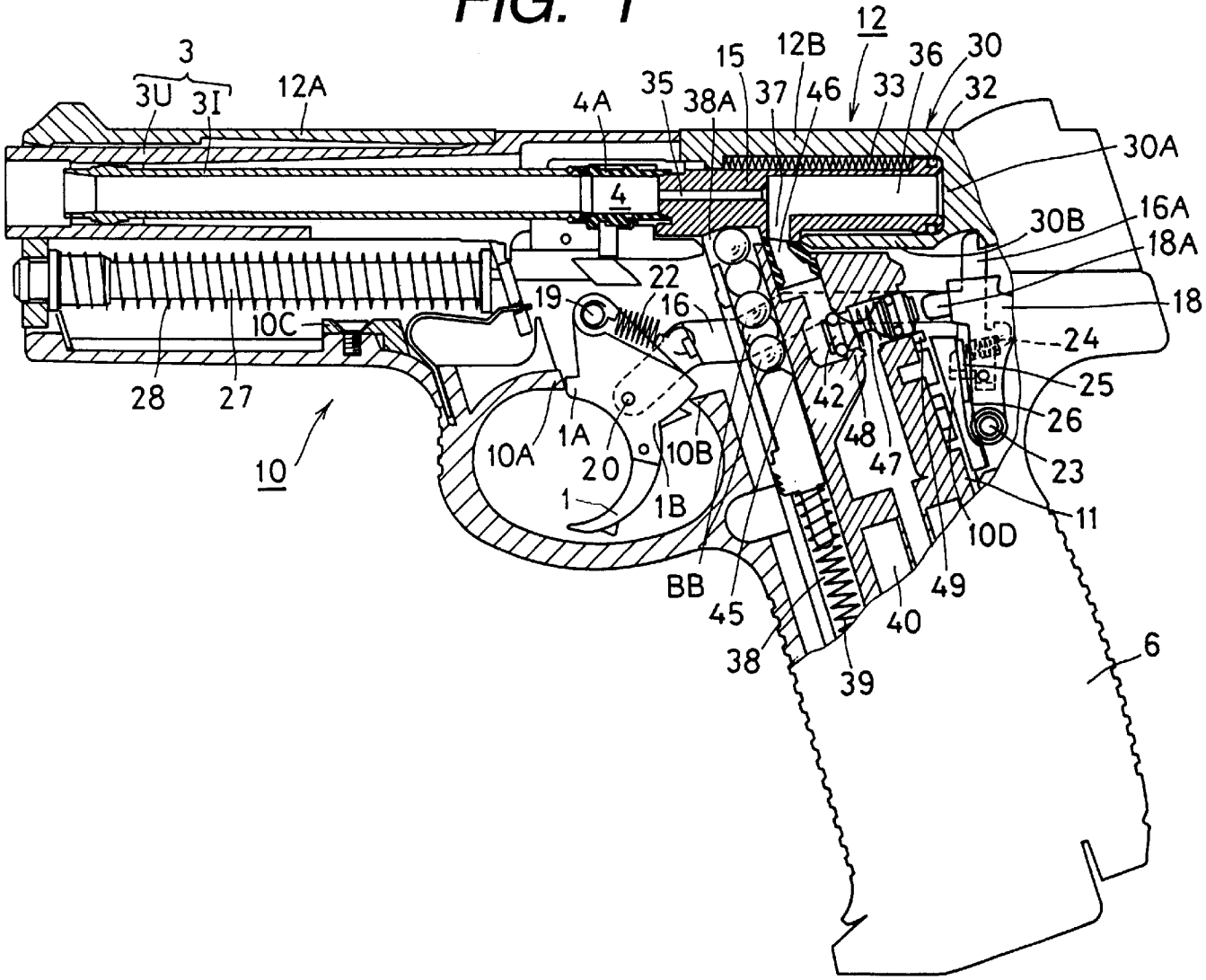
FIG. 1 is a schematic cross sectional view showing an embodiment of model gun with automatic bullet supplying mechanism according to the present invention.

FIG. 1 shows an embodiment of model gun with automatic bullet supplying mechanism according to the present invention.

Referring to FIG. 1, the embodiment has a body 10 in which a trigger 1, a barrel 3 comprising an outer barrel 3U and an inner barrel 3I, a bullet holding chamber 4 positioned just at the back of the barrel 3 and grip 6 are provided, a case 11 held to be detachable in the grip 6, a slider 12 provided to be movable along the barrel 3 and a movable member 15 provided in the slider 12. The bullet holding chamber 4 is formed in a rear portion of a tubular member 4A made of elastic frictional material, such as rubber. A front portion of the tubular member 4A is coupled with a rear end portion of the inner barrel 3I.

A movable bar member 16 and a hammer 18 are provided in the grip 6 and a front portion of the movable bar member 16 protruding from the grip 6 is connected to the trigger 1. The trigger 1 is attached to be rotatable to the body 10 with an axis 19 and the front portion of the movable bar member 16 is attached to be rotatable to the trigger 1 with an axis 20. The movable bar member 16 is shaped to extend from the trigger 1 toward a rear portion of the body 10 and movable forward and back.

When triggering, the trigger 1 is rotated on the axis 19 from a reference position at which a front contacting end portion 1A comes into contact with an engaging portion 10A provided on the body 10 as shown in FIG. 1 to a bullet shooting position at which a rear contacting recess 1B comes into contact with an engaging portion 10B provided on the body 10 as shown in FIG. 1. A coil spring 22 is provided to be engaged at both its end portions to the axis 19 and an engaging portion provided on the front portion of the movable bar member 16, respectively, so as to force the trigger 1 is such a direction that the front contacting end portion 1A of the trigger 1 comes into contact with the engaging portion 10A provided on the body 10.

A position limiting portion 16A is provided at a rear end portion of the movable bar member 16 to extend upward for limiting the position of the movable bar member 16 appropriately. The hammer 18 is positioned to be opposite to the position limiting portion 16A. The movable bar member 16 is able to transmit an operation force acting on the trigger 1 through the position limiting portion 16A to the hammer 18 in dependence of the mutual positional relation between the position limiting portion 16A and the hammer 18.

The hammer 18 is attached to be rotatable with an axis 23 to the body 10. A striking projection 18A is provided on an upper portion of the hammer 18 to protrude toward the trigger 1. A coil spring 24 is contained in a mid portion of the hammer 18 with a portion thereof projecting from the hammer 18 to the outside. The hammer 18 is further provided with a rotary member 25 which is in contact with the portion of the coil spring 24 projecting from the hammer 18. The rotary member 25 is attached to be rotatable with an axis 23 to the body 10, together with the hammer 18, and to be able to move relative to the hammer 18 within a predetermined range. The coil spring 24 provided between the hammer 18 and the rotary member 25 can expand and contract within a range limited by the rotary member 25.

A toggle spring 26 is put on the axis 23 on which the hammer 18 and the rotary member 25 are mounted in common. One end of the toggle spring 26 is engaged with the body 10 and the other end of the toggle spring 26 is engaged with the rotary member 25 so as to exert the elastic force to the rotary member 25 in tendency of moving forward. As a result, relatively large force by the toggle spring 26 acts on the hammer 18 through the rotary member 25.

The slider 12 has a first portion 12A forming a front portion which is engaged with the outer barrel 3U constituting the barrel 3 and a second portion 12B forming a rear portion which is incorporated with the first portion 12A to be positioned at the back of the barrel 3. When the trigger 1 is put in the reference position at which the front contacting end portion 1A comes into contact with the engaging portion 10A provided on the body 10, the slider 12 is put in a reference position with a front end of the first portion 12A positioned to be close to a front end of the body 10 and the second portion 12B positioned to cover a mid portion of the body 10 between the barrel 3 and the grip 6, as shown in FIG. 1.

The first portion 12A of the slider 12 is also engaged with a guide member 27 which extends along the barrel 3 in front of the trigger 1, so that the slider 12 as a whole is movable along the barrel 3. The guide member 27 is provided with a coil spring 28 which is concerned through the guide member 27 with the first portion 12A of the slider 12 and is operative to exert the elastic force to the first portion 12A to put the same in tendency of moving forward. The part of the first portion 12A of the slider 12 which is engaged with the guide member 27 is positioned to be opposite to a contact portion 10C provided on the body 10.

In the second portion 12B of the slider 12, a cup-shaped member 30 is provided. A bottom portion of the cup-shaped member 30 constitutes a pressure receiving portion 30A.

Further, in the second portion 12B of the slider 12, the movable member 15 is also provided. The movable member 15 is positioned between the bullet holding chamber 4 and the pressure receiving portion 30A constituted by the bottom portion of the cup-shaped member 30 in the slider 12 to be movable along moving directions of the slider 12. Then, the movable member 15 has a rear portion which is put selectively in and out of a tubular portion 30B of the cup-shaped member 30, a front portion which is coupled selectively with the rear portion of the tubular member 4A in which the bullet holding chamber 4 is formed, and a mid portion between the rear and front portions. A sealing ring member 32 made of elastic material is mounted on the rear portion of the movable member 15. When the rear portion of the movable member 15 is inserted in the tubular portion 30B of the cup-shaped member 30, the sealing ring member 32 comes into contact with the inner surface of the tubular portion 30B to seal hermetically a space between the outer surface of the rear portion of the movable member 15 and the inner surface of the tubular portion 30B.

A coil spring 33 is provided with one end attached to the tubular portion 30B of the cup-shaped member 30 and the other end attached to the movable member 15 for exerting the elastic force to the movable member 15 to put the same in tendency of moving toward the pressure receiving portion 30A which is provided in the form of the bottom portion of the cup-shaped member 30. When the slider 12 is put in the reference position, the movable member 15 is put in such a position as to cause the front portion thereof to be coupled with the rear portion of the tubular member 4A in which the bullet holding chamber 4 is formed and to cause the rear portion thereof to be inserted in the tubular portion 30B of the cup-shaped member 30.

The movable member 15 is provided therein with an internal space forming portion which forms a gas flow space including a first gas guiding passage 35 functioning as a bullet shooting gas flow space, a second gas guiding passage 36 functioning as a bullet supplying gas flow space, and a coupling passage 37 positioned between the first and second gas guiding passages 35 and 36 for coupling the first and second gas guiding passages 35 and 36 with each other.

The first gas guiding passage 35 is provided with its bore of, for example, about 2.9 mm for forming the bullet shooting gas flow space and the second gas guiding passage 36 is provided with its bore of, about 12.6 for forming the bullet supplying gas flow space. That is, the bore of the second gas guiding passage 36 forming the bullet supplying gas flow space is about 4.3 times larger than the bore of the first gas guiding passage 35 forming the bullet shooting gas flow space. This means that the first gas guiding passage 35 has its bore smaller than the bore of the second gas guiding passage 36, and consequently, resistance against the gas flow in the first gas guiding passage 35 forming the bullet shooting gas flow space is larger than that in the second gas guiding passage 36 forming the bullet supplying gas flow space.

The first gas guiding passage 35 has one end opening to face the bullet holding chamber 4 at the front portion of the movable member 15 and the other end connected with the coupling passage 37. The second gas guiding passage 36 has one end opening to face the pressure receiving portion 30A at the rear portion of the movable member 15 and the other end connected with the coupling passage 37. The coupling passage 37 forms a coupling space opening downward at the mid portion of the movable member 15 and the bullet shooting gas flow space formed by the first gas guiding passage 35 and the bullet supplying gas flow space formed by the second gas guiding passage 36 are coupled through the coupling space with each other. Accordingly, when the slider 12 is put in the reference position, one end of the bullet shooting gas flow space formed by the first gas guiding passage 35 is connected with the bullet holding chamber 4, one end of the bullet supplying gas flow space formed by the second gas guiding passage 36 is positioned to be contiguously opposite to the pressure receiving portion 30A and one end of the coupling space formed by the coupling passage 37 is positioned to be contiguously opposite to the upper end portion of the grip 6.

The internal space forming portion in the movable member 15 is not provided with valve means or other movable means in any of the first gas guiding passage 35, the second gas guiding passage 36 having the bore larger than that of the first gas guiding passage 35 and the coupling passage 37, and therefore the restriction in design to the movable member 15 is effectively reduced.

As described above, since the second gas guiding passages 36 which has the bore larger than that of the first gas guiding passage 35 is provided in the rear portion of the movable member 15 and the tubular portion 30B of the cup-shaped member 30 has the bore larger than that of the second gas guiding passage 36, the pressure receiving portion 30A provided in the form of the bottom portion of the cup-shaped member 30 has a pressure receiving area which is larger than the cross section of the bullet supplying gas flow space formed by the second gas guiding passage 36.

The case 11 is inserted into the grip 6 through an opening provided at a lower end portion of the grip 6 and a bottom portion portion of the case 11 is engaged with the lower end portion of the grip 6 so that the case 11 is held in the grip 6.

In the case 11, a magazine 38 for containing sham bullets BB, in which a coil spring 39 is provided for pushing the sham bullets BB toward an upper end portion 38A of the magazine 38, a pressure accumulating chamber 40 which is charged with, for example, liquefied gas, a gas leading passage 45 in which a movable valve 42 is put to be movable and which extends from the pressure accumulating chamber 40 to an upper end portion of the case 11, are provided. The gas leading passage 45 includes an upper gas passage portion 46 which comes into contact selectively with the coupling passage 37 provided in the movable member 15. The upper gas passage portion 46 is made of elastic material.

A coil spring 47 is mounted on the movable valve 42 put in the gas leading passage 45. The movable valve 42 is forced by the coil spring 47 to be positioned to close the gas leading passage 45 with one end portion thereof engaged with a circular engaging portion 48 provided on the case 11. A locking member 49 for engaging selectively with the other end portion of the movable valve 42 protruding from the case 11 is provided on the case 11. When the moving valve 42 is put in the position for making the gas leading passage 45 closed, the locking member 49 is pushed in the direction against the elastic force exerted by a coil spring which is not shown in the drawings by the movable valve 42 to be put in a lower position for disengaging from the movable valve 42.

In a condition wherein the case 11 is held in the grip 6, the upper end portion 38A of the magazine 38 is positioned to be close to the bullet holding chamber 4 and closed by the mid portion of the movable member 15. Therefore, the sham bullets BB contained in the magazine 38 are pushed against the elastic force exerted by the coil spring 39. The movable valve 42 is engaged with the circular engaging portion 48 so as to be positioned to make the gas leading passage 45 closed. Further, the upper gas passage portion 46 included in the gas leading passage 45 is connected with the coupling passage 37 provided in the movable member 15 so that the gas flow space formed by the gas leading passage 45 and each of the bullet shooting gas flow space formed by the first gas guiding passage 35 and the bullet supplying gas flow space formed by the second gas guiding passage 36 are connected with each other through the coupling space formed by the coupling passage 37.

Under this condition, the upper end portion of the position limiting portion 16A provided on the movable bar member 16 is in contact with the lower end portion of the second portion 12B of the slider 12 and the movable bar member 16 is prevented from rotating around the axis 20. The rotary member 25 provided on the hammer 18 is kept by the toggle spring 26 in the reference position to engage with an engaging portion 10D provided on the body 10 and the coil spring 24 provided between the hammer 18 and the rotary member 25 is kept to be expanded. Therefore, the hammer 18 is put in the reference position to cause the striking projection 18A provided thereon to be opposite to the movable valve 42 from the back of the movable member 15 with a distance within the range limited by the rotary member 25 put in the reference position. The hammer 18 thus put in the reference position is connected through the position limiting portion 16A provided on the movable bar member 16 with the trigger 1 put in the reference position. The movable bar member 16 is put in an operation force transmitting condition for being able to transmit the operation force acting on the trigger 1 to the hammer 18.

In the embodiment shown in FIG. 1 and thus constituted, after the case 11 has been held in the grip 6, the slider 12 is once moved back manually from the reference position with the movable member 15 and then released to move forward with the movable member 15 so as to return to the reference position with the elastic force by the coil spring 28.

Figure 2:
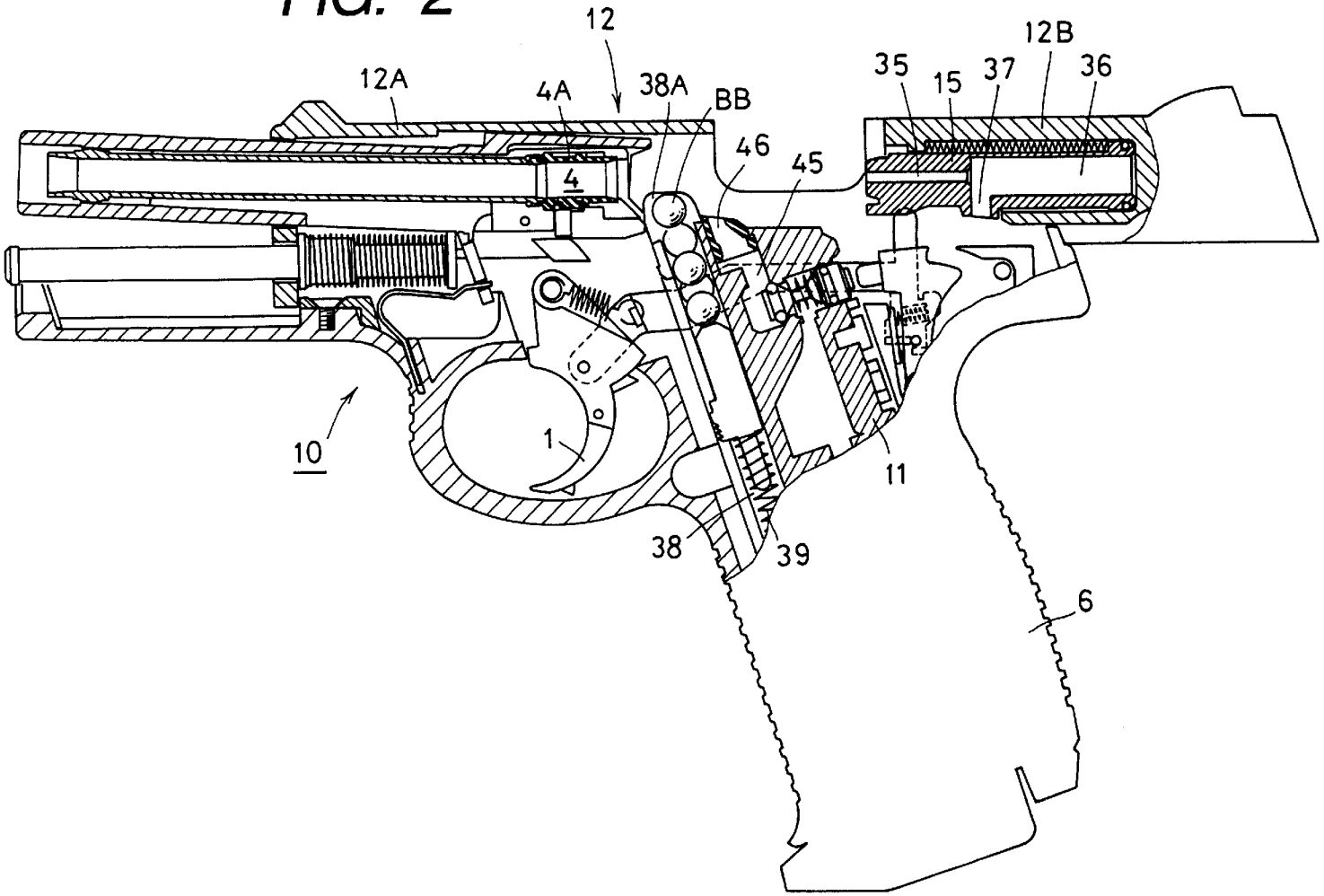
FIGS. 2, 3, 4, 5, 6, 7, 8 and 9 are schematic cross sectional views showing essential portions of the embodiment shown in FIG. 1 and used for explaining the construction and the operation of the embodiment shown in FIG. 1.
Figure 3:
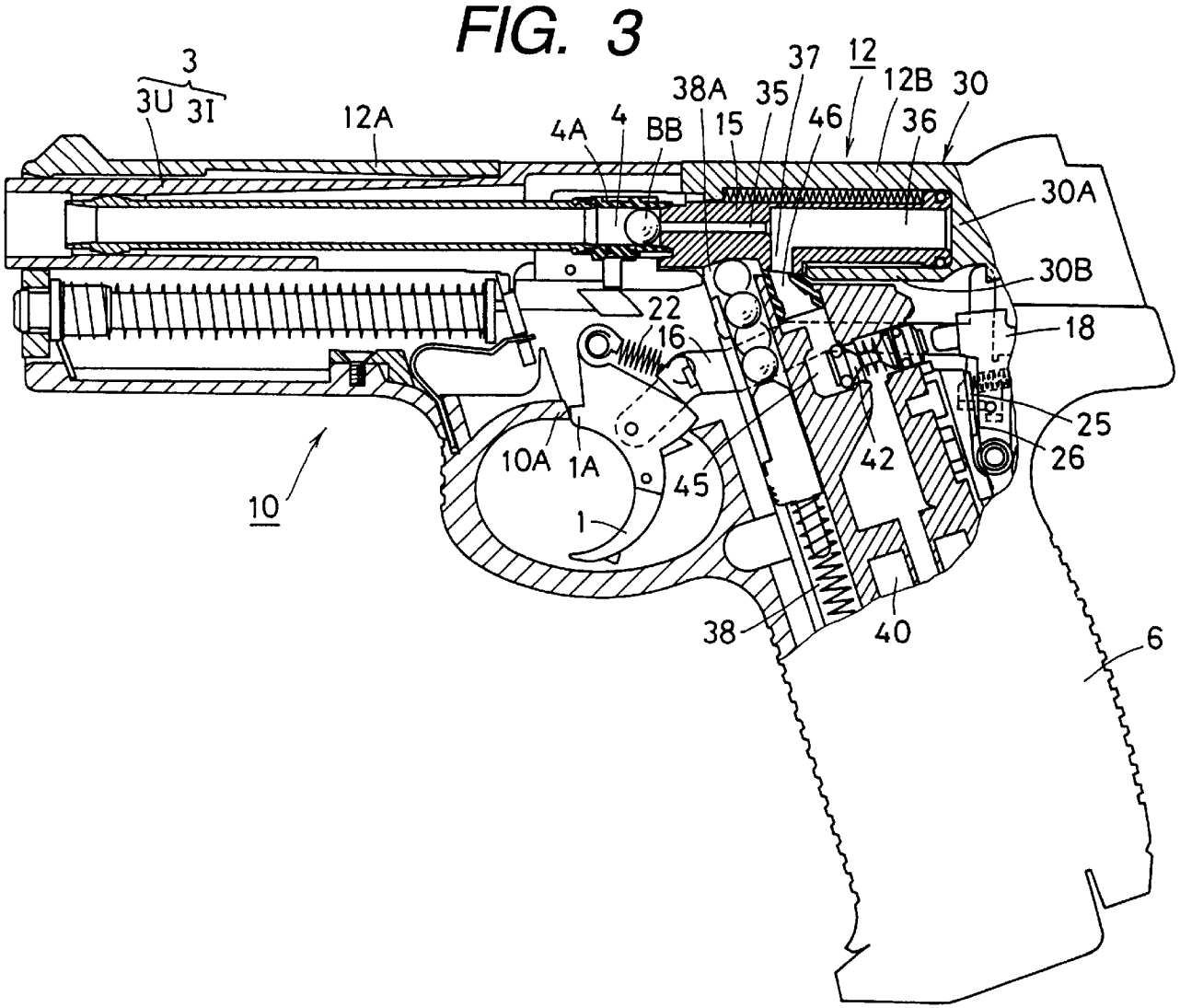

During such movements of the slider 12, the movable member 15 is moved back with the backward movement of the slider 12, so that the upper end portion 38A of the magazine 38 is made open and one of the sham bullets BB at the top in the magazine 38 is pushed up into the upper end portion 38A of the magazine 38 to be held therein by the coil spring 39, as shown in FIG. 2. Then, the sham bullet BB in the upper end portion 38A of the magazine 38 is carried to the tubular member 4A by the movable member 15 moved forward with the forward movement of the slider 12 and the upper end portion 38A of the magazine 38 is made closed again by the movable member 15. The front portion of the movable member 15 carrying the sham bullet BB is coupled with the portion of the tubular member 4A in which the bullet holding chamber 4 is formed so that the sham bullet BB carried by the movable member 15 is supplied to the bullet holding chamber 4 formed by the tubular member 4A, as shown in FIG. 3.

Figure 4:
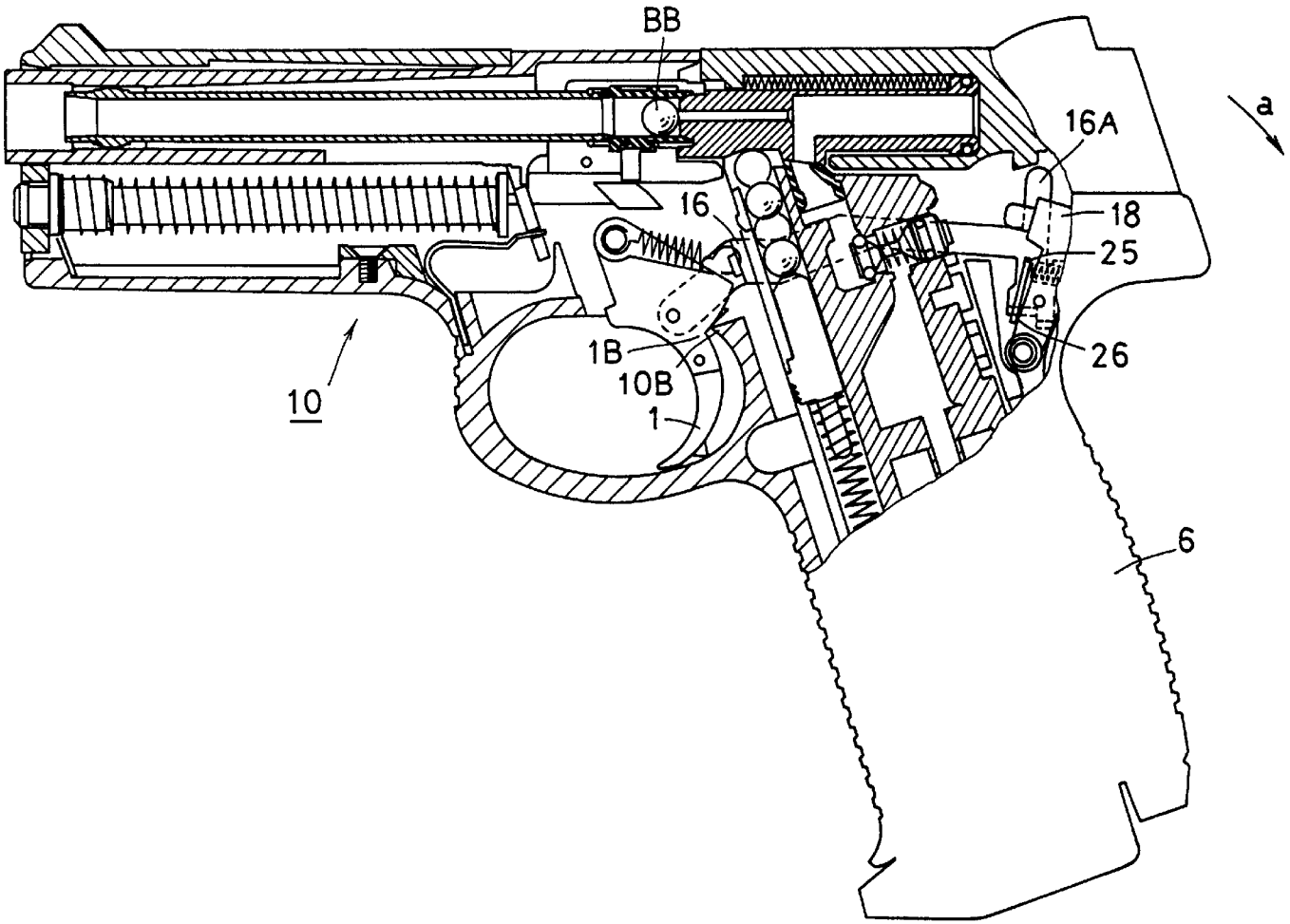

After the slider 12 has returned to the reference position, when the trigger 1 is pulled to rotate from the reference position toward the bullet shooting position, the movable bar member 16 is moved back against the elastic force exerted by the coil spring 22 in accordance with the rotating movement of the trigger 1 to cause the whole of the hammer 18 and the rotary member 25 to rotate in a direction shown with an arrow a in FIG. 4 (a direction) against the elastic force exerted by the toggle spring 26.

When the trigger 1 rotated toward the bullet shooting position has reached to a position just before the bullet shooting position as shown in FIG. 4, the position limiting portion 16A provided on the movable bar member 16 has been rotated by a slant portion provided on the body 10 (not shown in FIG. ) with which the position limiting portion 16A is in contact and thereby the movable bar member 16 is operative to release the hammer 18 from the operation force transmitting condition.

Figure 5:
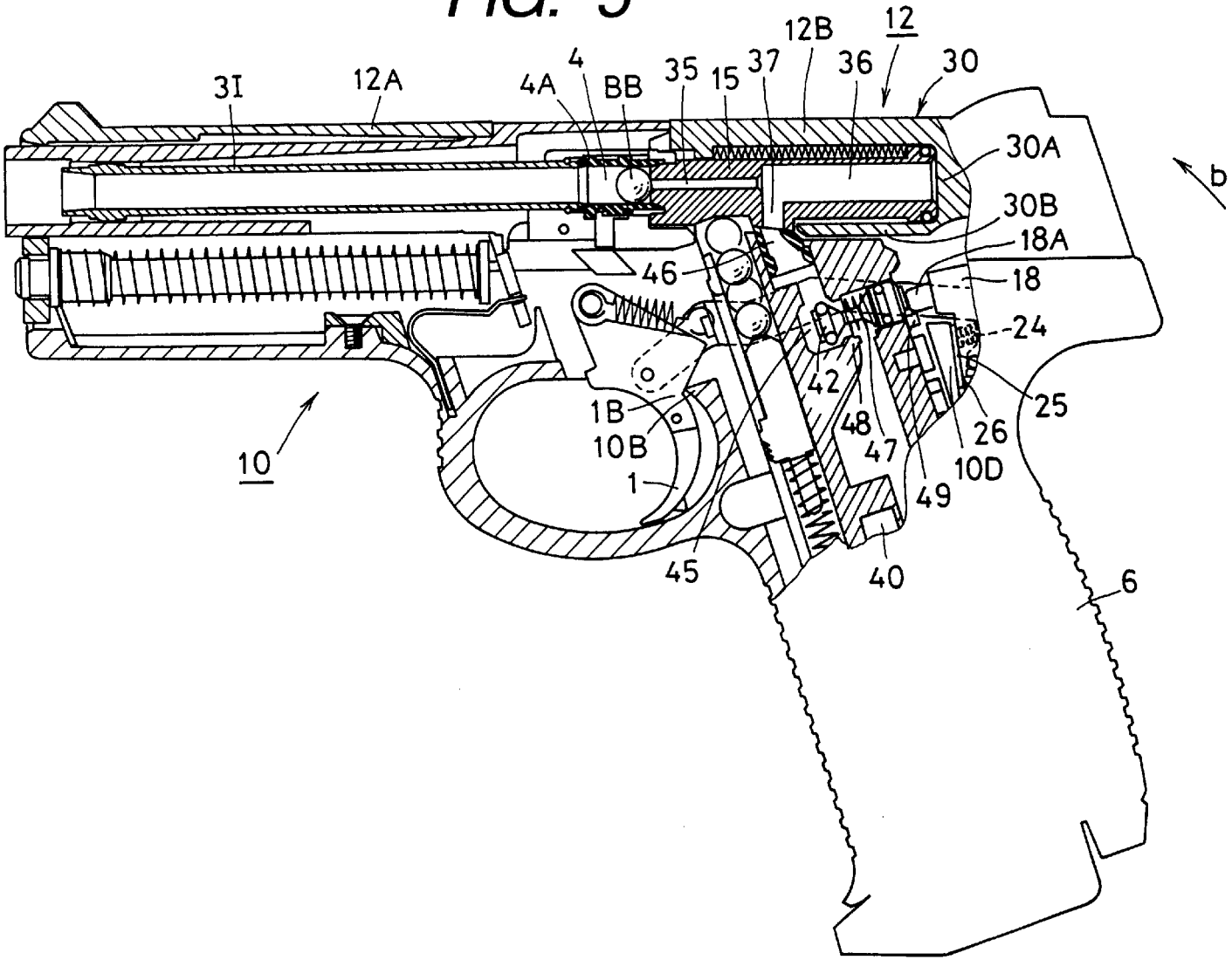

As a result, the hammer 18 and the rotary member 25 are rapidly rotated in a direction shown with an arrow b in FIG. 5 (b direction), reverse to the a direction, with the elastic force exerted by the toggle spring 26. When the rotary member 25 rotated in the b direction together with the hammer 18 has reached to the reference position to come into contact with the engaging portion 10D provided on the body 10, as shown in FIG. 5, the hammer 18 continues to rotate in the b direction due to inertia and to compress the coil spring 24. Then, when the trigger 1 has reached to the bullet shooting position, the hammer 18 rotated in the b direction due to the force of inertia has reached through the reference position to a striking position for causing the striking projection 18A to strike the movable valve 42.

Figure 6:
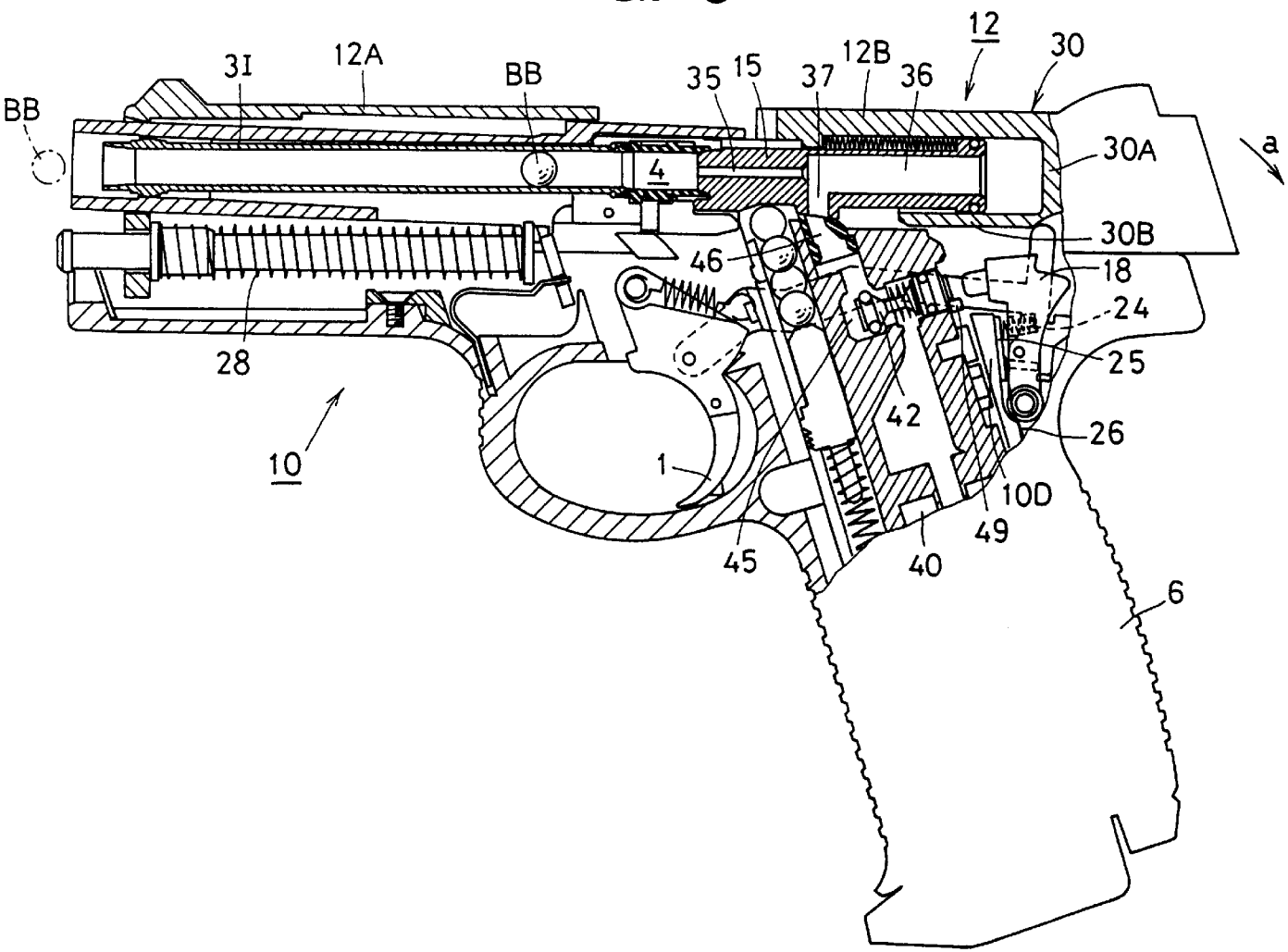

The movable valve 42 thus struck by the striking pojection 18A provided on the hammer 18 moves against the elastic force exerted by the coil spring 47 from the position for making the gas leading passage 45 closed to the position for making the gas leading passage 45 open. With this movement of the movable valve 42, the locking member 49 is released from the pressure by the movable valve 42 and moves from the lower position to the upper position for engaging with the movable valve 42 so as to keep the movable valve 42 in the position for making the gas leading passage 45 open, as shown in FIG. 6. The coil spring 24 compressed by the hammer 18 turns to expand when the hammer 18 has reached to the striking projection 18A for causing the striking projection 18A to strike the movable valve 42. With this change in condition of the coil spring 24, the hammer 18 rotates in the a direction and then limited to rotate by the rotary member 25 put in the reference position so that the hammer 18 returns to the reference position, as shown in FIG. 6.

Simultaneously with the above, when the movable valve 42 is struck by the striking projection 18A provided on the hammer 18 and thereby moves from the position for making the gas leading passage 45 closed to the position for making the gas leading passage 45 open, the gas from the pressure accumulating chamber 40 flows through the gas leading passage 45 opened by the movable valve 42 into the coupling passage 37 formed by the internal space forming portion in the movable member 15. The gas having flowed into the coupling passage 37 fills the bullet shooting gas flow space formed by the first gas guiding passage 35 and the bullet supplying gas flow space formed by the second gas guiding passage 36 and reaches through the first gas guiding passage 35 to the sham bullet BB held in the bullet holding chamber 4 and through the second gas guiding passage 36 to the pressure receiving portion 30A provided in the slider 12.

After the gas from the pressure accumulating chamber 40 initiates to flow through the gas leading passage 45 into the coupling passage 37 formed by the internal space forming portion in the movable member 15, each of gas pressure acting through the first gas guiding passage 35 on the sham bullet BB held in the bullet holding chamber 4 and gas pressure acting through the second gas guiding passage 36 on the pressure receiving portion 30A provided in the slider 12 increases rapidly.

The sham bullet BB held in the bullet holding chamber 4 is relatively light and therefore the gas pressure necessary for pushing the sham bullet BB forward from the bullet holding chamber 4 is much lower than the gas pressure necessary for moving the pressure receiving portion 30A back with the cup-shaped member 30 and the slider 12. Consequently, before the gas pressure acting on the pressure receiving portion 30A reaches to a pressure value with which the pressure receiving portion 30A is moved back with the cup-shaped member 30 and the slider 12, the sham bullet BB held in the bullet holding chamber 4 is pushed forward from the bullet holding chamber 4 into the inner barrel 3I by the gas pressure acting thereon, as shown with a solid line in FIG. 6, and then accelerated in the inner barrel 3I by the gas flowing through the first gas guiding passage 35 into the inner barrel 3I so as to be shot from the front end portion of the inner barrel 3I, as shown with a dot-dash line in FIG. 6. That is, when the hammer 18 is moved by the coil spring 24 to return to the reference position after the striking projection 18A provided on the hammer 18 strikes the movable valve 42, the sham bullet BB moved from the bullet holding chamber 4 to the inner barrel 3I is shot from the front end portion of the inner barrel 3I.

After the sham bullet BB is pushed forward from the bullet holding chamber 4 into the inner barrel 3I and then shot from the inner barrel 3I, the first gas guiding passage 35 is opened to the inner barrel 3I and further to the outside of the inner barrel 3I. However, since the bore of the first gas guiding passage 35 is considerably smaller than the bore of the second gas guiding passage 36 and therefore the resistance against the gas flow in the first gas guiding passage 35 forming the bullet shooting gas flow space is larger than that in the second gas guiding passage 36 forming the bullet supplying gas flow space, the gas flowing from the pressure accumulating chamber 40 through the gas leading passage 45 into the coupling passage 37 provided in the movable member 15 still flows through the first gas guiding passage 35 and simultaneously is efficiently guided through the second gas guiding passage 36 in which the resistance against the gas flow is smaller than that in the first gas guiding passage 35 to the pressure receiving portion 30A even after the first gas guiding passage 35 is opened to the inner barrel 3I and further to the outside of the inner barrel 3I.

When the gas pressure acting on the pressure receiving portion 30A has reached to the pressure value with which the pressure receiving portion 30A is moved back with the cup-shaped member 30 and the slider 12 after the sham bullet BB is pushed forward from the bullet holding chamber 4 into the inner barrel 3I, the pressure receiving portion 30A is rapidly moved back to create a pressure chamber having variable capacity between the rear end portion of the movable member 15 and the pressure receiving portion 30A in the cup-shaped member 30 and the slider 12 is also rapidly moved back, together with the pressure receiving portion 30A, from the reference position against the elastic force exerted by the coil spring 28, as shown in FIG. 6.

Figure 7:
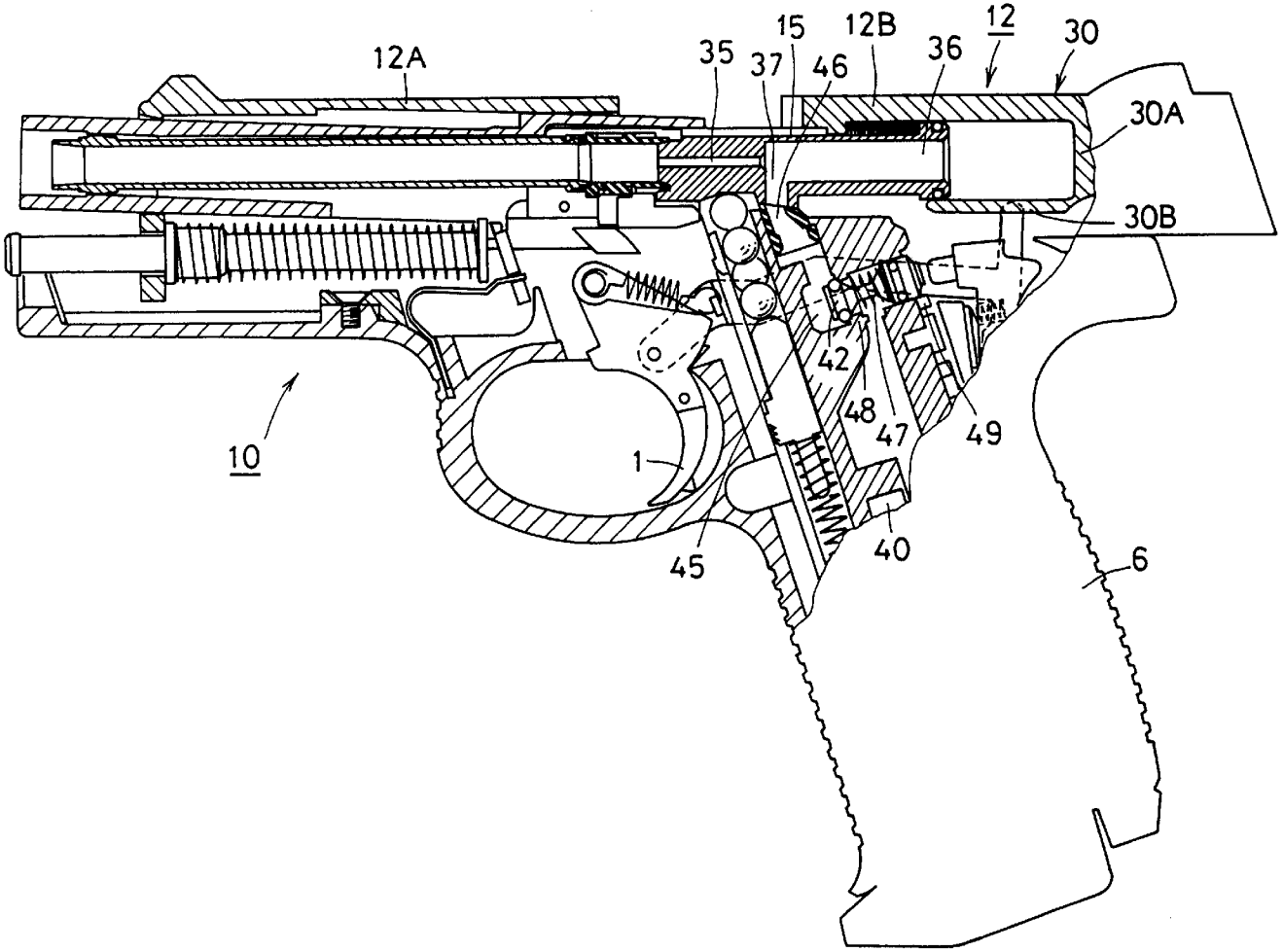

With the backward movement of the slider 12, the locking member 49 put in the upper position is pushed downward by a pushing portion (not shown in the drawings) to move into the lower position, as shown in FIG. 7. Consequently, the movable valve 42 is moved from the position for making the gas leading passage 45 open to the position for making the gas leading passage 45 closed by the elastic force exerted by the coil spring 47, so that the supply of the gas from the pressure accumulating chamber 40 through the second gas guiding passage 36 to the pressure chamber having variable capacity is stopped and the slider 12 continues to move back with the gas pressure remains in the cup-shaped member 30.

Figure 8:
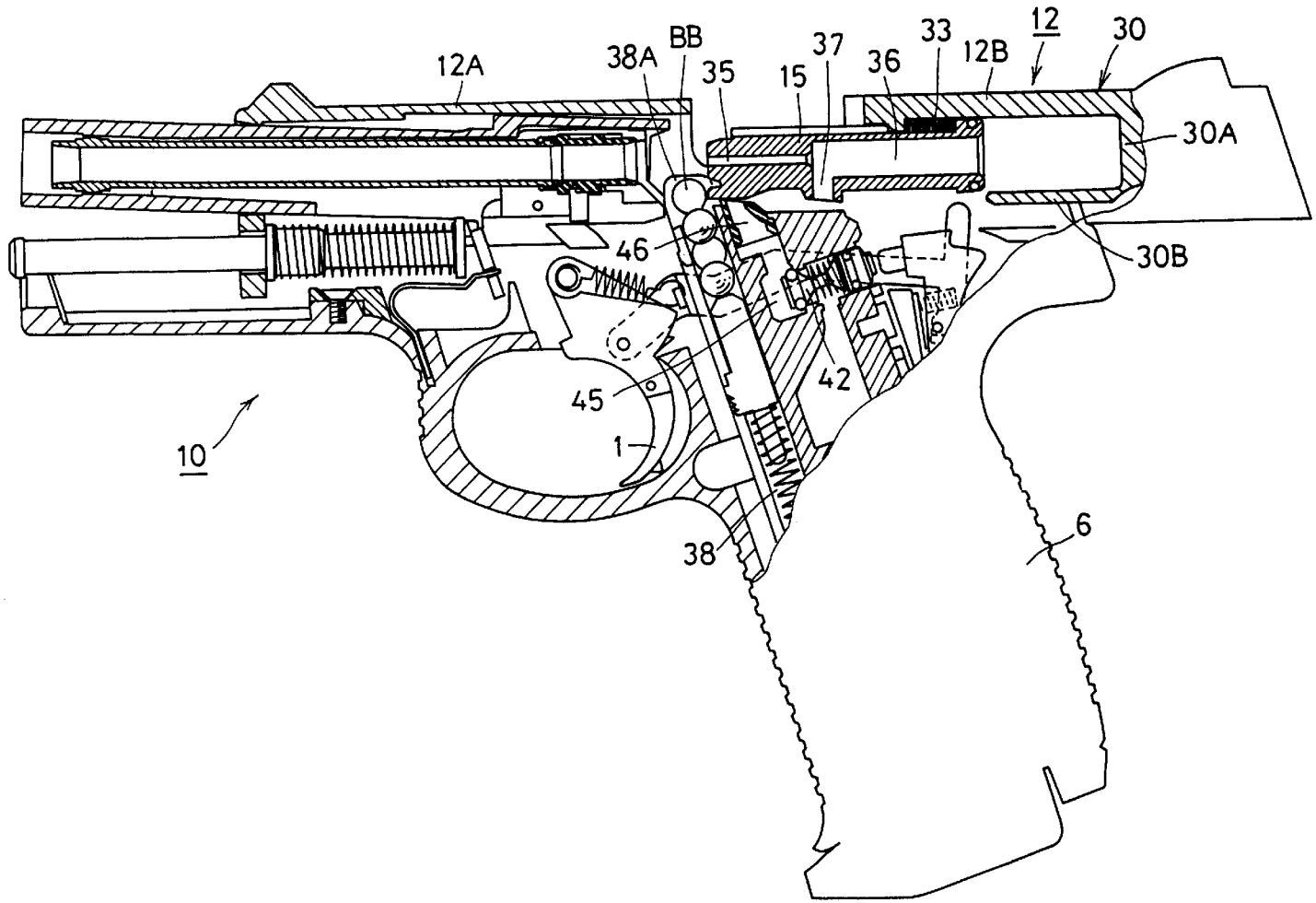

During the backward movement of the slider 12 continued after the supply of the gas from the pressure accumulating chamber 40 to the pressure chamber having variable capacity has been stopped, the rear portion of the movable member 15 is put out of the tubular portion 30B of the cup-shaped member 30 so that the gas in the cup-shaped member 30 is discharged through an opening formed to be close to the rear portion of the movable member 15 and the gas pressure in the cup-shaped member 30 is quickly reduced to be the atmospheric pressure, as shown in FIG. 8.

With such quick reduction in the gas pressure in the cup-shaped member 30, the movable member 15 is rapidly moved back to be inserted again in the cup-shaped member 30 by the elastic force exerted by the coil spring 33. As a result, the upper end portion 38A of the magazine 38 which has been closed be the movable member 15 is made open and one of the sham bullets BB at the top in the magazine 38 is pushed up into the upper end portion 38A of the magazine 38 to be held therein. Besides, the coupling passage 37 provided in the movable member 15 is released from the connection with the upper gas passage portion 46 included in the gas leading passage 45 and therefore the gas pressure in the cup-shaped member 30 is reduced further rapidly.

Figure 9:
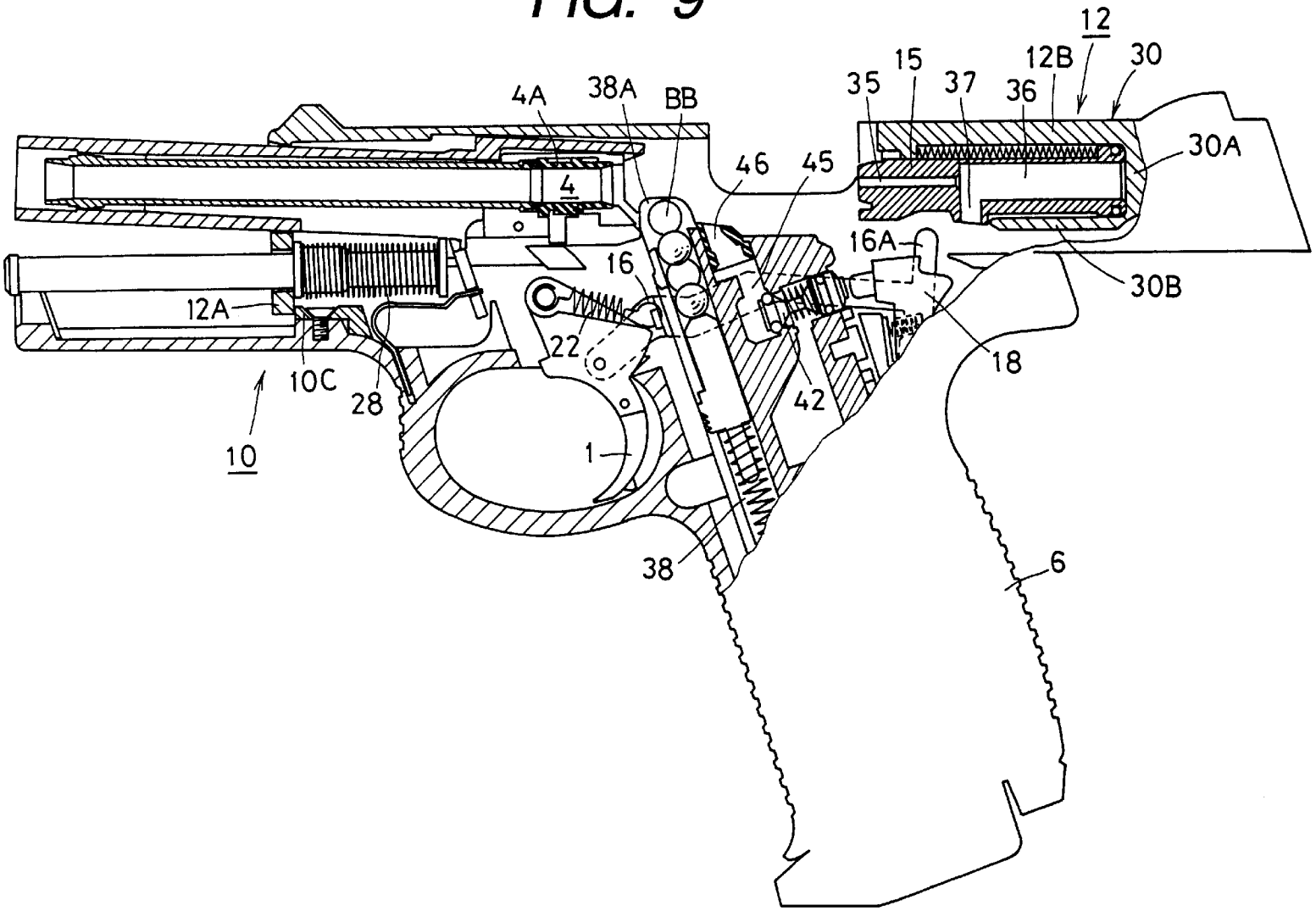

The slider 12 is further moved back with the force of inertia so as to reach to the rearmost position at which the first portion 12A of the slider 12 comes into contact with the contact portion 10C provided on the body 10, as shown in FIG. 9. This backward movement of the slider 12 from the reference portion to the rearmost position is carried out regardless of the movement of the hammer 18 from the position for causing the striking projection 18A to strike the movable valve 42 to the reference position and therefore such a disadvantage that the relatively strong elastic force exerted by the toggle spring 26 to act on the hammer 18 affects the backward movement of the slider 12 as resistance is avoided. Consequently, the gas pressure necessary for moving the pressure receiving portion 30A back with the cup-shaped member 30 and the slider 12 is reduced to be relatively low. Further, the first portion 12A of the slider 12 comes into contact with the contact portion 10C provided on the body 10 so as to bring about relatively large impact when the slider 12 reaches to the rearmost position and thereby desirable relatively large recoil can be surely obtained.

Just after the slider 12 has been reached to the rearmost position as shown in FIG. 9, the slider 12 is moved forward to the reference position by the elastic force exerted by the coil spring 28 and the movable member 15 is also moved forward together with the slider 12. With such forward movement of the movable member 15, the front portion of the movable member 15 carries the sham bullet BB held in the upper end portion 38A of the magazine 38 to the bullet holding chamber 4. Therefore, the sham bullet BB is surely supplied to the bullet holding chamber 4 when the slider 12 is put in the reference position again, as shown in FIG. 3.

When the slider 12 has reached to the rearmost position in such a manner as mentioned above, the trigger 1 is released from the operation for pulling and moved with the movable bar member 16 to return to the reference position from the bullet shooting position by the elastic force exerted by the coil spring 22, as shown in FIG. 3. The movable bar member 16 which has moved in accordance with the movement of the trigger 1 to return to the reference position is restricted in position with the upper end of the position limiting portion 16A which is in contact with the lower end of the second portion 12B of the slider 12 and put again in the operation force transmitting condition.

Further, the slider 12 has returned to the reference position from the rearmost position, one end portion of the first gas guiding passage 35 provided in the movable member 15 is connected with the bullet holding chamber 4, one end portion of the second gas guiding passage 36 provided in the movable member 15 is positioned to be contiguously opposite to the pressure receiving portion 30A and the upper gas passage portion 46 included in the gas leading passage 45 extending from the pressure accumulating chamber 40 is connected with the coupling passage 37 provided in the movable member 15. Then, the above explained operation is repeatedly performed to shoot the sham bullet BB held in the bullet holding chamber 4 and supply the bullet holding chamber 4 with a new sham bullet BB when the trigger 1 is pulled again.

Although the bore of the second gas guiding passage 36 provided in the movable member 15 is about 4.3 times, that is, more than 4 times larger than the bore of the first gas guiding passage 35 provided in the movable member 15 in the embodiment shown in FIGS. 1 to 9, it is to be understood that the present invention is not limited to the embodiment in which the bore of the second gas guiding passage 36 is more than 4 times larger than the bore of the first gas guiding passage 35 and it is possible to set first and second gas guiding passages in a movable member, in consideration of the weight of a slider, the weight of a sham bullet, the area of a pressure receiving portion and so on, in such a manner that the first gas guiding passage has its bore smaller than the bore of the second gas guiding passage and therefore resistance against gas flow in the first gas guiding passage is larger than that in the second gas guiding passage.

In the case where such an arrangement that the first gas guiding passage has its bore smaller than the bore of the second gas guiding passage is made in consideration of the weight of the slider, the weight of the sham bullet, the area of the pressure receiving portion and so on, it is possible to cause the slider to commence to move back after the sham bullet has been shot out of the front end of an inner barrel.

What is claimed is:

1. A model gun with automatic bullet supplying mechanism, which comprises:

a pressure accumulating chamber from which a gas leading passage extends, a bullet holding chamber provided just at the back of a barrel, a moveable valve for controlling the gas leading passage to be opened and closed selectively in accordance with the operation of a trigger pulled in order to cause a sham bullet supplied to the bullet holding chamber to be shot, a slider provided to be movable along the barrel, a gas pressure receiving portion fixed in the slider to be positioned at the back of the barrel and movable with the slider, and a movable member provided between the bullet holding chamber and the pressure receiving portion and movable in moving directions of the slider, said movable member being provided therein with a first gas guiding passage for guiding as supplied through the gas leading passage from the pressure accumulating chamber to the bullet holding chamber and a second gas guiding passage for guiding the gas supplied through the gas leading passage from the pressure accumulating chamber to the pressure receiving portion to be coupled with each other and, during a period in which the gas leading passage is opened by the movable valve, the movable member is operative to cause gas pressure to act on the sham bullet supplied to the bullet holding chamber so as to move the sham bullet forward from the bullet holding chamber and, after the sham bullet has moved forward from the bullet holding chamber, to cause gas pressure to simultaneously pass through the first gas guiding passage and the second gas guiding passage to act on the pressure receiving portion so as to move the pressure receiving portion back with the slider, in accordance with a difference in resistance against gas flow between the first and second gas guiding passages, and further to move back together with the slider for making preparations for supplying the bullet holding chamber with a sham bullet from a magazine.

2. A model gun with automatic bullet supplying mechanism according to claim 1, wherein said first gas guiding passage has a bore smaller than a bore of said second gas guiding passage.

3. A model gun with automatic bullet supplying mechanism according to claim 2, wherein said second gas guiding passage has a bore more than 4 times larger than a bore of said first gas guiding passage.

4. A model gun with automatic bullet supplying mechanism according to claim 1, wherein said movable member is provided therein with a coupling passage for connecting selectively both of said first and second gas guiding passages with the gas leading passage extending from said pressure accumulating chamber.

5. A model gun with automatic bullet supplying mechanism according to claim 1, said slider is provided therein with a cup-shaped member comprising a tubular portion having a bore larger than the bore of the second gas guiding passage in said movable member and a bottom portion forming said pressure receiving portion.

* * * * *